United States Patent [19]

Bissonnette

[11] Patent Number: 4,981,423

[45] Date of Patent: Jan. 1, 1991

[54] HYDRAULIC MOTOR WITH WOBBLE-STICK AND BRAKE ASSEMBLY

[75] Inventor: Lee A. Bissonnette, Lafayette, Ind.

[73] Assignee: TRW Inc., Lyndhurst, Ohio

[21] Appl. No.: 416,472

[22] Filed: Oct. 3, 1989

[51] Int. Cl.[5] ..... F03C 2/08

[52] U.S. Cl. ..... 418/61.3; 418/102; 418/104; 418/181

[58] Field of Search ..... 418/61.3, 104, 102, 418/181

[56] References Cited

U.S. PATENT DOCUMENTS

| | | | |
|---|---|---|---|
| 3,536,230 | 10/1970 | Williams | 192/3 |
| 3,616,882 | 11/1971 | White | 418/61.3 |
| 3,771,905 | 11/1973 | Ohrberg et al. | 418/61.3 |
| 3,960,470 | 6/1976 | Kinder | 418/61.3 |
| 4,739,865 | 4/1988 | Yater et al. | 418/181 |

FOREIGN PATENT DOCUMENTS

84/01800 5/1984 World Int. Prop. O. ..... 418/61.3

OTHER PUBLICATIONS

Torqmotor MG, MF, MB, ME Series Service Procedure.

*Primary Examiner*—John J. Vrablik
*Assistant Examiner*—David L. Cavanaugh
*Attorney, Agent, or Firm*—Tarolli, Sundheim & Covell

[57] ABSTRACT

A hydraulic device includes a hydraulic motor having a wobble shaft driven by a rotor of a gerotor gear set. An outer end of the wobble shaft is received in a hollow inner end portion of an output shaft. A brake assembly holds the motor output shaft against rotation when the hydraulic motor is being operated. A seal blocks fluid flow between the brake assembly and the hydraulic motor. The seal is disposed in sealing engagement with the hollow end portion of the output shaft at a location between the motor and the brake assembly.

18 Claims, 3 Drawing Sheets

HYDRAULIC MOTOR WITH WOBBLE-STICK AND BRAKE ASSEMBLY

BACKGROUND OF THE INVENTION

The present invention relates to a device that includes a hydraulic motor which is operable to drive an output shaft and a brake assembly which is engageable to hold the output shaft against rotation when the motor is in an inactive condition.

A known hydraulic device having a motor which drives an output shaft and a brake assembly which holds the output shaft against rotation when the motor is in an inactive condition is described in U.S. Pat. No. 3,960,470, issued June 1, 1976 and entitled "Hydraulic Motor Brake". This known hydraulic device includes a motor of the gerotor gear type. During operation of the motor, a rotor orbits and rotates relative to a stator. A portion of a wobble or drive shaft is connected with the rotor for orbital and rotational movement with the rotor. An outer end portion of the drive shaft is telescopically received in a hollow inner end portion of an output shaft. During operation of the motor, the drive shaft rotates the output shaft.

The hydraulic device of the aforementioned U.S. Pat. No. 3,960,470 includes a brake assembly which is connected to a portion of the drive or wobble shaft and is disposed on a side of the motor opposite from the output shaft. The brake assembly includes movable disks which rotate and orbit with the drive shaft during operation of the hydraulic motor and stationary disks which are interleaved with the movable disks. When the motor is in an inactive condition, the movable and stationary brake disks are pressed together to hold the drive shaft and, therefore, the output shaft against rotation. When the motor is to be operated, the brake assembly is released to enable the drive shaft to rotate and orbit.

SUMMARY OF THE INVENTION

The present invention provides a hydraulic device which includes a hydraulic motor and a brake assembly. The motor includes a stator and a rotor having cooperating teeth which define fluid pockets. The rotor rotates and orbits relative to the stator when hydraulic fluid is directed to the pockets. An inner end portion of a wobble or drive shaft is connected with the rotor for rotational and orbital movement with the rotor relative to the stator. An outer end portion of the wobble shaft is received in a hollow inner end portion of a rotatable output shaft.

The brake assembly is connected with the output shaft. Prior to initiation of operation of the motor, the brake assembly holds the output shaft against rotation. Upon initiation of operation of the motor, the brake assembly is operated to a disengaged condition to allow the output shaft to be freely rotated by the hydraulic motor.

A seal is provided to block fluid flow between the brake assembly and the hydraulic motor. The seal engages an outer surface on the hollow end portion of the output shaft. The seal is disposed between the brake assembly and a fluid flow passage through which fluid is directed to the motor. The fluid flow passage is formed in the hollow end portion of the output shaft. The seal blocks hydraulic fluid flow between the motor and the brake assembly while allowing hydraulic fluid flow through the passage during operation of the motor.

BRIEF DESCRIPTION OF THE DRAWINGS

The foregoing and other features of the present invention will become more apparent to one skilled in the art upon a consideration of the following description of a preferred embodiment of the present invention taken in connection with the accompanying drawings, wherein.

DESCRIPTION OF ONE SPECIFIC PREFERRED EMBODIMENT OF THE INVENTION

Figure 1:
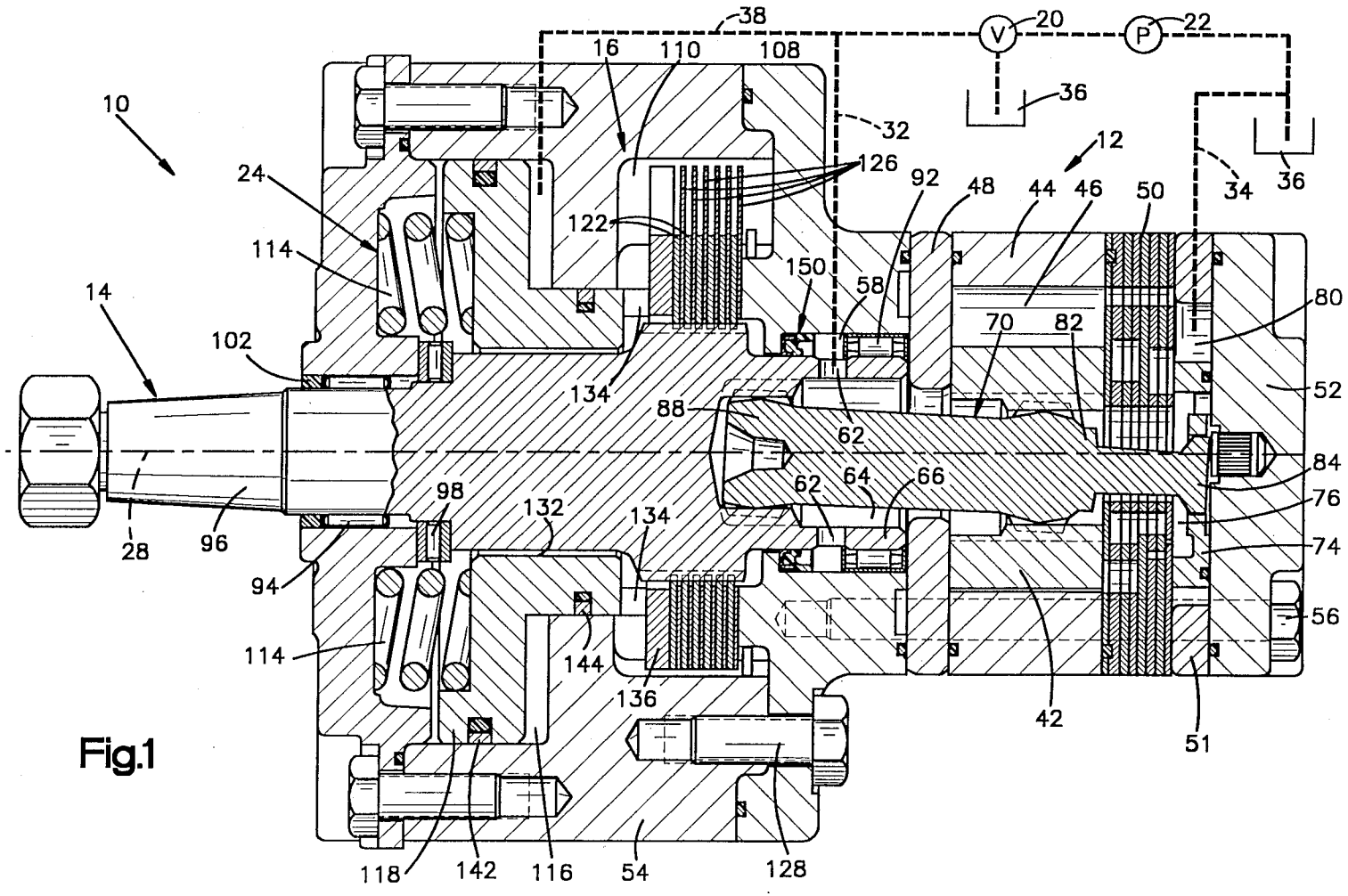
FIG. 1 is a sectional view of a hydraulic device having a motor which is operable to rotate an output shaft and a brake assembly which is operable to hold the output shaft against rotation when the motor is in an inactive condition.

A hydraulic device 10 (FIG. 1) includes a hydraulic motor 12 having a rotatable output shaft 14. A brake assembly 16 is provided to hold the output shaft 14 against rotation when the hydraulic motor 12 is not being operated. Although the hydraulic device 10 can be used in many different environments to provide the driving force for many different known types of devices, the hydraulic device 10 is particularly useful for driving vehicle wheels, winches, or conveyors.

When the hydraulic motor 12 is to be operated, a valve 20 is actuated to connect hydraulic fluid pressure from a pump 22 with both the hydraulic motor 12 and the brake assembly 16. As the hydraulic pressure transmitted from the valve 20 to the brake assembly 16 increases, an actuator 24 in the brake assembly operates the brake assembly to a disengaged condition. Thereafter, as the fluid pressure conducted from the valve 20 continues to increase, the hydraulic motor 12 begins to operate. Operation of the hydraulic motor 12 results in the output shaft 14 being rotated about its central axis 28.

When the hydraulic motor 12 is to be stopped, the valve 20 is again actuated. This results in both the hydraulic motor 12 and the brake assembly 16 being connected with low pressure, that is with drain or reservoir 36. As the hydraulic fluid pressure decreases, the motor 12 slows down. As the hydraulic pressure decreases still further, the brake assembly 16 is actuated to hold the output shaft 14 against rotation.

During operation of the hydraulic motor 12, there is a continuous flow of hydraulic fluid from the valve 20 through the conduit 32 to the motor to supply working fluid to the motor. There is also a continuous flow of fluid from the hydraulic motor 12 through a conduit 34 to drain or reservoir 36. Although there is a continuous flow of fluid through the hydraulic motor 12 during operation of the motor, there is a relatively static body of hydraulic fluid in the brake assembly 16. When the valve 20 is operated, hydraulic fluid pressure is transmitted through a conduit 38 to the brake assembly 16 to operate the actuator 24. Since there is relatively little fluid flow into and out of the brake assembly 16, the brake assembly is not subjected to the same volume of system contaminants as may be transmitted through the hydraulic motor 12.

The hydraulic motor 12 is of the known gerotor gear type and includes an externally toothed rotor 42 which cooperates with an internally toothed stator 44 to define a plurality of fluid pockets 46. The rotor 42 is circumscribed by the stator 44. The left (as viewed in FIG. 1) end of the rotor 42 slidably engages a wear plate 48. The opposite end of the rotor 42 slidably engages one of a plurality of stationary valve or manifold plates 50 which are brazed together. On the side of the manifold plates 50 opposite the rotor 42 are a thick annular plate 51 and then an end cap 52. Bolts 56 extend through the end cap 52, the plate 51, the manifold plates 50, stator 44 and wear plate 48 to secure all of these components to a brake assembly housing 54.

An inner end portion 82 of a drive or wobble shaft 70 is connected with the rotor 42 for orbital and rotational movement with the rotor. One end portion 82 of the drive shaft 70 has external splines which mesh with internal splines on the rotor 42. The splined connection between the end portion 82 of the drive shaft 70 and rotor 42 allows the end portion of the drive shaft to rock or pivot relative to the rotor during orbital and rotational movement of the rotor.

The nose or tip 84 of the end portion of the drive shaft 70 is received in a circular opening in a commutator valve 74 encircled by the plate 51. The nose 84 of the drive shaft 70 moves the commutator valve 74 along a circular path in synchronism with orbital movement of the rotor 42.

An outer or left (as viewed in FIG. 1) end portion 88 of the drive shaft 70 is telescopically received in a hollow inner end portion 66 of the output shaft 14. External splines on the end portion 88 of the drive shaft mesh with internal splines on the hollow inner end portion 66 of the output shaft 14. The splined connection between the drive shaft 70 and output shaft 14 allow the end portion 88 of the drive shaft to rock or pivot relative to the hollow inner end portion 66 of the output shaft 14.

The output shaft 14 is supported for rotation about its longitudinal central axis 28. The hollow inner end portion 66 of the output shaft 14 is supported by an annular inner radial bearing assembly 92. The radial inner bearing assembly 92 is connected with the housing 54. The inner bearing assembly 92 has a plurality of roller-type bearing elements which engage a radially outer circumferential surface on the hollow end portion 66 of the output shaft 14.

An annular outer radial bearing assembly 94 is disposed between a solid outer end portion 96 of the output shaft 14 and the brake assembly housing 54 to support the outer end portion of the output shaft. The outer bearing assembly 94 has a plurality of roller-type bearing elements which engage a radially outer circumferential surface on the outer end portion of the output shaft 14. A thrust bearing assembly 98 is disposed between radially extending surfaces on the shaft 14 and the housing 54 to transmit axially directed forces from the output shaft 14 to the housing 54. A dirt and water seal 102 is provided axially outwardly of the radial bearing assembly 94. The outer end portion 96 of the output shaft 14 is adapted to be connected with a member to be driven by the hydraulic motor 12.

During operation of the hydraulic motor 12, high pressure hydraulic fluid flows from the pump 22 through the valve 20 and conduit 32 into an annular inlet cavity 58. The inlet cavity is located between the inner and outer radial bearing assemblies 92 and 94 and is defined, in part, by the outer circumferential surface of the hollow inner end portion of the output shaft 14 and the brake assembly housing 54. The hydraulic fluid flows from the cavity 58 through a plurality of passages 62 in the inner end portion 66 of the output shaft 14 into a cavity 64 formed in the hollow inner end portion. The hydraulic fluid then flows axially along the outside of the drive or wobble shaft 70, through the rotor 42, and through the manifold plates 50.

The commutator valve 74 cooperates with the manifold plates 50 to direct high pressure hydraulic fluid from a cavity 76 inside the circular commutator valve to expanding fluid pockets 46 formed between the rotor 42 and stator 44. At the same time, hydraulic fluid is directed from contracting fluid pockets 46 through the stationary manifold plates 50 to an annular chamber 80 defined between the annular plate 51 and the commutator valve 74 and which circumscribes the commutator valve. The chamber 80 is connected with drain or reservoir 36 through the conduit 34.

As the fluid pockets 46 sequentially expand and contract, the rotor 42 rotates about its own central axis and orbits about the central axis of the stator 44 in a known manner. Rotation of the rotor rotates the drive shaft 70, which, in turn, rotates the output shaft 14. The manner in which the rotor 42 cooperates with the stator 44 to define fluid pockets, the manner in which the commutator valve 74 directs hydraulic fluid to expanding pockets and from contracting pockets, and the manner in which the rotor 42 drives the wobble shaft 70 and output shaft 14 are the same as is disclosed in U.S. Pat. No. 3,601,513, issued Aug. 24, 1971 and entitled "Hydraulic Device".

The hydraulic brake assembly 16 includes an annular brake pad assembly or disk pack 108 and the actuator 24, which actuates the disk pack. The disk pack is disposed in an annular cavity 110 formed in the housing 54 around the output shaft 14.

Figure 2:
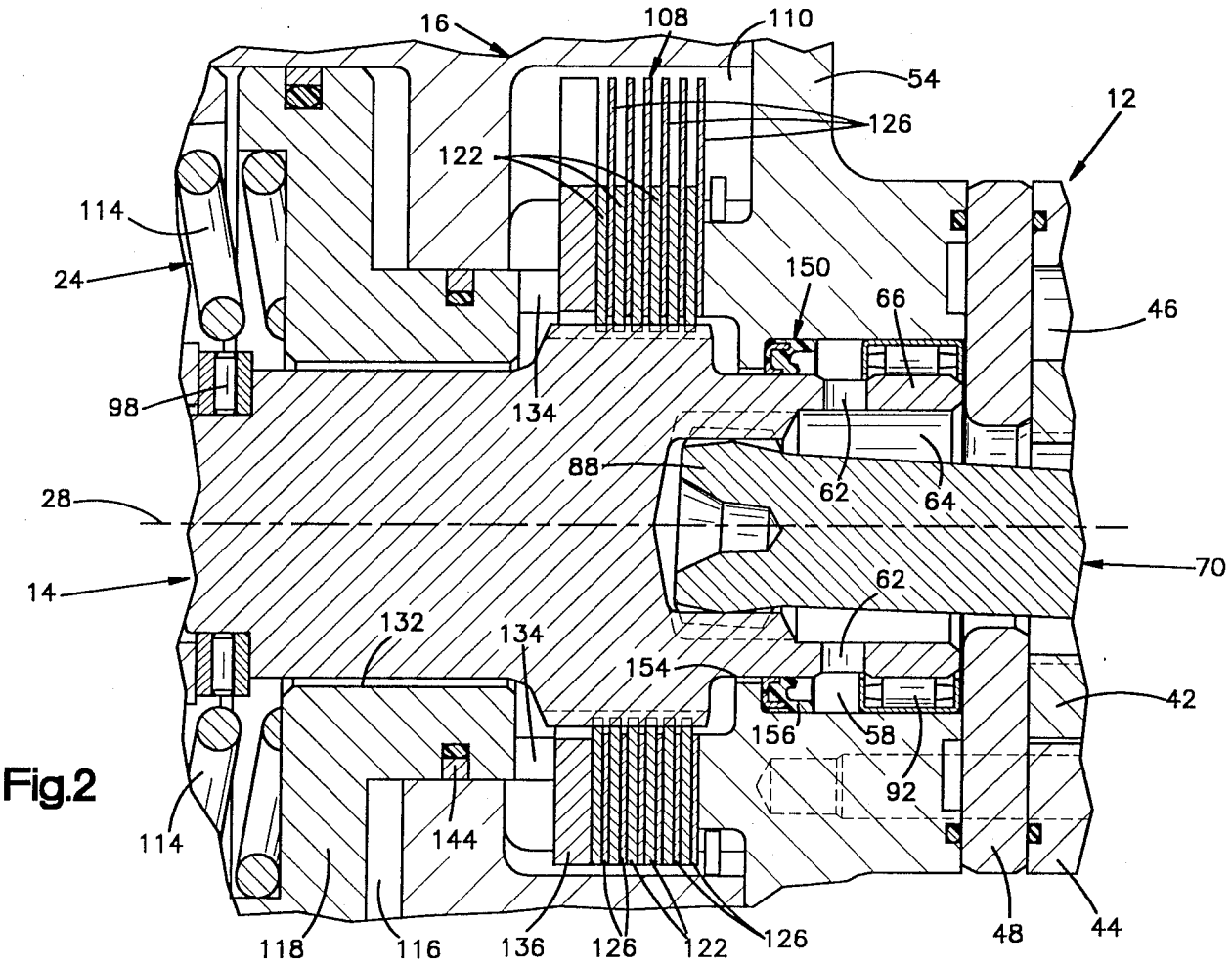
FIG. 2 is an enlarged fragmentary sectional view of a portion of the hydraulic device of FIG. 1 and illustrating the relationship between a high pressure seal and a hollow inner end portion of the output shaft.

The disk pack 108 includes a plurality of annular inner brake disks 122 (FIG. 2). Each of the annular inner brake disks 122 has internal splines on its radially inner circumferential surface which engage external splines on the radially outer circumferential surface of the output shaft 14 at a location between the inner and outer radial bearings 92 and 94 (FIG. 1). The splines on the inner brake disks 122 (FIG. 2) and output shaft 14 interconnect the inner brake disks and output shaft for rotation together relative to the housing 54.

A plurality of annular outer brake disks 126 (FIG. 2) are interleaved with the annular inner brake disks 122. Each of the outer brake disks 126 has external splines on its radially outer circumferential surface which engage internal splines on an internal circumferential surface of the housing 54 to hold the outer brake disks against rotation relative to the housing. The generally annular outer brake disks 126 have relatively large recesses in their outer circumferences to accommodate bosses in the housing 54 where bolts 128 (FIG. 1) interconnect sections of the housing 54.

The actuator 24 includes an annular piston 118 having a circular central opening 132 through which the output shaft 14 extends. The piston 118 is pressed toward the right (as viewed in FIG. 1) by a plurality of coil springs 114. The pressure exerted by the springs 114 against the piston 118 is transmitted by projections 134 on the right (as viewed in FIG. 1) end of the piston 118 to an annular brake disk pad 136. The brake disk pad 136 is pressed against the disk pack 108 to clamp the disk pack between the annular brake disk pad and the housing 54. The clamping force applied against the disk pack 108 by the piston 118 presses the flat side surfaces of the inner and outer brake disks 122 and 126 firmly together so that friction forces between the brake disks hold the output shaft 14 against rotation.

Between a radially extending surface of the piston 118 opposite the springs 114 and a radially extending surface of the housing 54 is an annular actuator cylinder chamber 116. The chamber 116 is connected to the pump 22 through the valve 20 and the conduit 38. Hydraulic pressure introduced into the chamber 116 will act in opposition to the springs 114 to release the disk pack.

A pair of annular seals 142 and 144 (FIG. 1) are provided between the actuator piston 118 and the housing 54. The seals 142 and 144 block the leakage of hydraulic fluid from the cylinder chamber 116. Since hydraulic fluid cannot leak out of the cylinder chamber 116 and since the volume of the cylinder chamber increases by a relatively small amount when the piston 118 is moved to release the disk pack 108, there is a very small volume of fluid flow into the cylinder chamber. This tends to minimize the amount of contaminants to which the brake assembly 16 is exposed.

When the disk pack 108 (FIG. 2) is compressed by the springs 114 in the actuator 24, the flat, radially extending side surfaces on the inner brake disks 122 are pressed against the flat, radially extending side surfaces on the outer brake disks 126. Friction between flat radially extending side surfaces of the inner and outer brake disks 122 and 126 holds the output shaft 14 against rotation relative to the housing 54.

When hydraulic fluid pressure is conducted from the valve 20 to the annular actuator cylinder chamber 116, the piston 118 is moved toward the left (as viewed in FIG. 1) against the force of the springs 114. As the piston 118 moves leftward and the springs 114 are compressed, the clamping force applied against the disk pack 108 is released. When the clamping force against the disk pack 108 is released, the inner brake disks 122 are free to rotate with the output shaft 14 relative to the outer brake disks 126 and housing 54. The chamber 110 is filled with hydraulic fluid which tends to minimize friction between the inner and outer disks 122 and 126 when the disk pack 108 is in a disengaged condition.

When the disk pack 108 is in the release or disengaged condition, the output shaft 14 is free to rotate relative to the housing 54. When the valve assembly 20 is operated to connect the actuator assembly 24 and hydraulic motor 12 with drain 36, the coil springs 114 press the piston 118 toward the right (as viewed in FIG. 1) to operate the disk pack 108 to an engaged condition. When the disk pack 108 is in an engaged condition, it holds the output shaft 14 against rotation relative to the housing 54.

A high pressure shaft seal 150 (FIGS. 1 and 2) separates the hydraulic fluid pressure in the motor 12 from the brake assembly 16. The annular seal 150 circumscribes the hollow inner end portion 66 of the output shaft 14 and the outer end portion 88 of the drive or wobble shaft 70. The seal 150 is located between the inner and outer radial bearings 92 and 94 (FIG. 1) so that there is minimal deflection of the output shaft 14 where it engages the seal 150. The annular seal 150 extends radially between a radially outer circumferential surface 154 (FIG. 2) on the hollow inner end portion 66 of the output shaft 14 and a radially inner circumferential surface 156 on the housing 54.

Figure 3:
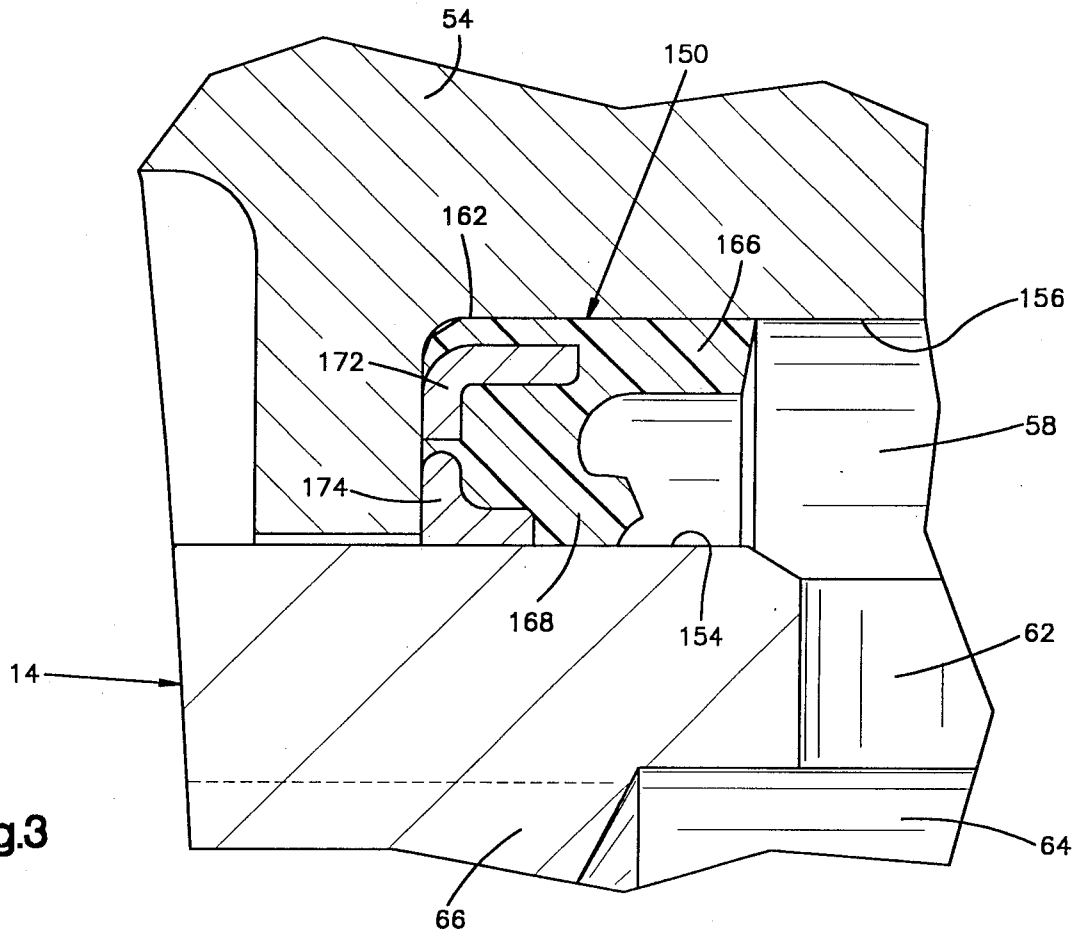
FIG. 3 is an enlarged fragmentary sectional view depicting the construction of the seal.

The high pressure seal 150 is disposed in an annular recess 162 (FIG. 3) formed in the housing 54. During rotation of the output shaft 14, the high pressure seal 150 remains stationary in the housing 54. An annular outer lip 166 on the seal 150 is pressed radially outwardly against the circumferential surface 156 of the housing 54 by hydraulic fluid pressure in the inlet cavity 58. This results in firm sealing engagement between the lip 166 and the surface 156 of the housing 54.

A second annular lip 168 (FIG. 3) on the seal 150 is pressed radially inwardly against the cylindrical outer side surface 154 on the hollow inner end portion 66 of the output shaft 14 by the hydraulic fluid pressure in the inlet cavity 58. This results in a firm sealing engagement between the output shaft 14 and the high pressure seal 150 during rotation of the output shaft by the hydraulic motor. A pair of annular reinforcing rings 172 and 174 are provided in the body of polymeric material forming the seal 150 to support the lips 166 and 168.

The seal 150 engages the hollow inner end portion 66 of the output shaft 14 at a location that is axially outward, that is toward the left, as viewed in FIGS. 1 and 2, of inner bearing assembly 92 and the radial passages 62 which extend between the inlet cavity 58 and the cavity 64 on the inside of hollow end portion 66 of the output shaft 14. This enables the seal 150 to block outward or leftward (as viewed in FIG. 2) flow of high pressure hydraulic fluid from the inlet cavity 58 along the output shaft 14 toward the disk pack cavity 110 in the brake assembly 16.

If there were a relatively high pressure present in the disk pack cavity 110, the axially inner or rightward (as viewed in FIG. 2) end of the piston 118 would be exposed to this relatively high fluid pressure. The fluid pressure would retard operation of the brake assembly 16 to an engaged condition when operation of the motor 12 is stopped. Specifically, the relatively high fluid pressure in the disk pack chamber 110 would require time to dissipate when the valve 20 is operated to connect the inlet chamber 58 and actuator cylinder chamber 116 with the drain 36. The high pressure seal 150 prevents the inner or right (as viewed in FIG. 2) end of the piston 118 from being exposed to the relatively high motor operating fluid pressures so that the brake assembly 16 can be quickly engaged.

The seal 150 blocks fluid flow between the hydraulic motor 12 (FIG. 1) and the brake assembly 16 while allowing fluid to flow from the inlet cavity 58 to the hydraulic motor. Hydraulic fluid conducted from the conduit 32 can flow through the inlet cavity 58 into the cavity 64 on the inside of the hollow inner end portion 66 of the output shaft 14.

In view of the foregoing description, it is apparent that the present invention provides a new and improved hydraulic device. Further, it should be apparent that changes, modifications, and additions may be made to the preferred embodiment. It is intended to cover all such changes, modifications and additions within the scope of the appended claims.

Having described a preferred embodiment of the invention, the following is claimed:

1. A hydraulic device comprising:

a housing;

a hydraulic motor having an output shaft extending from said housing, said motor comprising a stator and a rotor having cooperating teeth defining fluid pockets, said rotor rotating and orbiting relative to said stator when hydraulic fluid is directed to said fluid pockets;

said output shaft having a hollow end portion located in said housing;

a wobble shaft connected to said rotor and to said hollow end portion of said output shaft to rotate said output shaft upon rotational and orbital movement of said rotor, said wobble shaft having an inner end portion connected with said hydraulic motor and an outer end portion disposed in said hollow inner end portion of said output shaft, said inner end portion of said wobble shaft being adapted for both orbital and rotational motion by said hydraulic motor, said outer end portion of said wobble shaft being adapted for rotational motion with said hollow inner end portion of said output shaft;

a brake assembly in said housing and connected to said output shaft, said brake assembly including means urging it to an operating condition braking said output shaft; and seal means for blocking fluid flow between said brake assembly and said hydraulic motor, said seal means engaging said housing and an outer surface of said hollow end portion of said output shaft;

said brake assembly being connected to said output shaft at a location between said seal means and an outer end portion of said output shaft adapted to be connected with a member to be driven by said hydraulic motor.

2. A hydraulic device as set forth in claim 1 wherein said hollow end portion of said output shaft includes passage means extending between the outer surface of said hollow end portion of said output shaft and an inner surface of the hollow end portion of said output shaft in a direction transverse to the axis of rotation of said output shaft to conduct hydraulic fluid flow during rotational and orbital movement of said rotor relative to said stator, said seal means being disposed in sealing engagement with the outer surface of said hollow end portion of said output shaft at a location disposed axially along said output shaft between said passage means and said brake assembly.

3. A hydraulic device comprising:

a housing;

a hydraulic motor having an output shaft extending from said housing, said motor comprising a stator and a rotor having cooperating teeth defining fluid pockets, said rotor rotating and orbiting relative to said stator when hydraulic fluid is directed to said fluid pockets;

said output shaft having a hollow end portion located in said housing;

a wobble shaft connected to said rotor and to said hollow end portion of said output shaft to rotate said output shaft upon rotational and orbital movement of said rotor, said wobble shaft having an inner end portion connected with said hydraulic motor and an outer end portion disposed in said hollow inner end portion of said output shaft, said inner end portion of said wobble shaft being adapted for both orbital and rotational motion by said hydraulic motor, said outer end portion of said wobble shaft being adapted for rotational motion with said hollow inner end portion of said output shaft;

a brake assembly in said housing and connected to said output shaft, said brake assembly including means urging it to an operating condition braking said output shaft; and seal means for blocking fluid flow between said brake assembly and said hydraulic motor, said sail means engaging said housing and an outer surface of said hollow end portion of said output shaft;

said hollow end portion of said output shaft including passage means extending between the outer surface of said hollow end portion of said output shaft and an inner surface of said hollow end portion of said output shaft in a direction transverse to the axis of rotation of said output shaft to conduct hydraulic fluid flow during rotational and orbital movement of said rotor relative to said stator, said seal means being disposed in sealing engagement with the outer surface of said hollow end portion of said output shaft at a location disposed axially along said output shaft between said passage means and said brake assembly.

4. A hydraulic device as set forth in claim 3 wherein said brake assembly includes a first plurality of brake elements connected to said output shaft for rotation therewith about the longitudinal axis of said output shaft during orbital and rotational movement of said rotor relative to said stator, a second plurality of brake elements interleaved with said first plurality of brake elements and connected to said housing, and actuator means for pressing said first and second pluralities of brake elements together to retard rotation of said output shaft relative to said housing.

5. A hydraulic device as set forth in claim 4 wherein said actuator means includes an annular piston which circumscribes said output shaft and spring means for urging said annular piston toward said first and second pluralities of brake element to press said first and second pluralities of brake element together, said annular piston being movable in a direction away from said first and second pluralities of brake elements under the influence of hydraulic pressure applied against said annular piston.

6. A hydraulic device as set forth in claim 3 wherein said seal means sealingly engages the outer surface of said hollow end portion of said output shaft at a location which is disposed radially outwardly of said wobble shaft.

7. A hydraulic device as set forth in claim 3 further including bearing means for supporting said hollow end portion of said output shaft for rotation, said seal means being disposed in sealing engagement with the outer surface of said hollow end portion of said output shaft at a location disposed axially along said output shaft between said bearing means and said brake assembly.

8. A hydraulic device as set forth in claim 3 wherein said seal means circumscribes said hollow end portion of said output shaft and one end portion of said wobble shaft.

9. A hydraulic device as set forth in claim 3 wherein said hydraulic motor further includes a commutator valve connected with a first end portion of said wobble shaft and movable relative to said stator by said wobble shaft to direct fluid flow during rotational and orbital movement of said rotor relative to said stator, said wobble shaft having a second portion disposed in said hollow end portion of said output shaft, said rotor being connected with said wobble shaft at a location between said first and second end portions of said wobble shaft.

10. A hydraulic device as set forth in claim 7 wherein said seal means circumscribes said second end portion of said wobble shaft.

11. A hydraulic device comprising:

a rotatable output shaft having a hollow inner end portion and an outer end portion;

a brake assembly connected with said output shaft for reading rotation of said output shaft;

a hydraulic motor;

a drive shaft interconnecting said hydraulic motor and said output shaft, said drive shaft having an inner end portion connected with said hydraulic motor and an outer end portion disposed in said hollow inner end portion of said output shaft, said inner end portion of said drive shaft being adapted for both orbital and rotational motion by said hydraulic motor, said outer end portion of said drive shaft being adapted for rotational motion with said hollow inner end portion of said output shaft;

seal means for blocking fluid flow between said brake assembly and said hydraulic motor, said sail means being disposed in sealing engagement with said output shaft at a location between said hydraulic motor and said brake assembly;

a housing;

first bearing means disposed adjacent to the outer end portion of said output shaft for at least partially supporting the outer end portion of said output shaft for rotation relative to said housing; and second bearing means disposed in engagement with the hollow inner end portion of said output shaft for at least partially supporting the hollow inner end portion of said output shaft for rotation relative to said housing, said brake assembly being connected with a portion of said output shaft disposed between said first and second bearing means, said seal means being disposed in sealing engagement with said output shaft at a location axially between said second baring mean said brake assembly.

12. A hydraulic device as set forth in claim 11 wherein said hollow inner end portion of said output shaft includes passage means extending between radially inner and outer surfaces of said hollow inner end portion of said output shaft to conduct hydraulic fluid flow during operation of said hydraulic motor, said seal means being disposed in sealing engagement with said output shaft at a location disposed axially along said output shaft between said passage means and said brake assembly.

13. A hydraulic device as set forth in claim 11 wherein said seal means and said second bearing means are disposed in engagement with an outer surface of the hollow end portion of said output shaft and with said housing.

14. A hydraulic device as set forth in claim 13 wherein said hollow end portion of said output shaft includes passage means extending between the outer surface of the hollow end portion of said output shaft at a location axially between said seal means and second bearing means and an inner surface of the hollow end portion of said output shaft to conduct hydraulic fluid flow during operation of said hydraulic motor.

15. A hydraulic device as set forth in claim 13 wherein said seal means and said second bearing means circumscribe the outer end portion of said drive shaft.

16. A hydraulic device as set forth in claim 11 wherein said brake assembly includes a first plurality of brake elements which are connected with said output shaft for rotation therewith at a location between said first bearing means and said seal means and a second plurality of brake elements which are interleaved with said first plurality of brake elements and are connected with said housing in such a manner as to be held against rotation with said output shaft and said first plurality of brake elements.

17. A hydraulic device as set forth in claim 11 wherein said hydraulic motor includes a stator and a rotor having a cooperating teeth defining fluid pockets, said rotor being a rotatable and orbital relative to said stator when hydraulic fluid is directed to said fluid pockets, said inner end portion of said drive shaft being connected with said rotor for orbital and rotational movement therewith when hydraulic fluid is directed to said fluid pockets.

18. A hydraulic device as set forth in claim 17 further including surface means for at least partially defining a fluid receiving cavity which circumscribes said drive shaft and through which hydraulic fluid flows during hydraulic fluid flow to said pockets, said seal means including means for blocking hydraulic fluid flow from said cavity to said brake assembly during hydraulic fluid flow to said pockets.

* * * * *

UNITED STATES PATENT AND TRADEMARK OFFICE

CERTIFICATE OF CORRECTION

PATENT NO. : 4,981,423

DATED : January 1, 1991

INVENTOR(S) : Lee A. Bissonnette

It is certified that error appears in the above-identified patent and that said Letters Patent is hereby corrected as shown below:

Column 8, Line 37, Claim 5, Change "element" to --elements--.

Column 8, Line 38, Claim 5, Change "element" to --elements--.

Column 9, Line 39, Claim 11, Change "baring mean said" to --bearing means and said--.

Signed and Sealed this

Twenty-first Day of April, 1992

*Attest:*

HARRY F. MANBECK, JR.

*Attesting Officer*

*Commissioner of Patents and Trademarks*